US006183066B1

(12) United States Patent
Tamura et al.

(10) Patent No.: US 6,183,066 B1
(45) **Date of Patent: *Feb. 6, 2001**

(54) INK JET RECORDING HEAD HAVING A COMMON WIRING STRUCTURE AND INK JET RECORDING APPARATUS

(75) Inventors: Yasuyuki Tamura, Yokohama; Shin'ichi Hirasawa, Sagamihara, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/927,801

(22) Filed: Sep. 11, 1997

Related U.S. Application Data

(63) Continuation of application No. 08/361,238, filed on Dec. 21, 1994, now abandoned.

(30) Foreign Application Priority Data

Dec. 22, 1993 (JP) ..... 5-324743

(51) Int. Cl.[7] ..... B41J 2/05; B41J 2/14; B41J 2/16

(52) U.S. Cl. ..... 347/58; 347/48; 347/57

(58) Field of Search ..... 347/48, 57, 58, 347/180, 182, 208, 209, 12, 13, 11; 29/890.1

(56) References Cited

U.S. PATENT DOCUMENTS

| | | | | |
|---|---|---|---|---|
| 4,313,124 | | 1/1982 | Hara | 346/140 R |
| 4,345,262 | | 8/1982 | Shirato et al. | 346/140 R |
| 4,458,256 | * | 7/1984 | Shirato et al. | 347/58 |
| 4,459,600 | | 7/1984 | Sato et al. | 346/140 R |
| 4,463,359 | | 7/1984 | Ayata et al. | 346/1.1 |
| 4,558,333 | | 12/1985 | Sugitani et al. | 346/140 R |
| 4,608,577 | | 8/1986 | Hori | 346/140 R |
| 4,631,555 | | 12/1986 | Ikeda et al. | 346/140 R |
| 4,672,391 | * | 6/1987 | Hakoyama et al. | 347/209 |
| 4,723,129 | | 2/1988 | Endo et al. | 346/1.1 |
| 4,740,796 | | 4/1988 | Endo et al. | 346/1.1 |
| 4,847,639 | | 7/1989 | Sugata et al. | 346/140 R |
| 4,887,099 | | 12/1989 | Terai et al. | 346/140 R |
| 5,477,243 | * | 12/1995 | Tamura | 347/12 |
| 5,504,505 | * | 4/1996 | Tamura et al. | 347/57 |

FOREIGN PATENT DOCUMENTS

| | | | |
|---|---|---|---|
| 0549211 | | 6/1993 | (EP) . |
| 54-56847 | | 5/1979 | (JP) . |
| 59-123670 | | 7/1984 | (JP) . |
| 59-138461 | | 8/1984 | (JP) . |
| 60-71260 | | 4/1985 | (JP) . |
| 60-208251 | | 10/1985 | (JP) . |
| 2150356 | * | 6/1990 | (JP) ..... 347/48 |

* cited by examiner

*Primary Examiner*—Thinh Nguyen
(74) *Attorney, Agent, or Firm*—Fitzpatrick, Cella, Harper & Scinto

(57) ABSTRACT

An ink jet recording apparatus includes an ink jet recording head as an essential component, and the ink jet recording head has a wiring structure which assures that a quantity of electricity loss induced by wiring resistance can be reduced. A plurality of substantially rectangular heaters 2 are formed at the positions in the vicinity of one end edge 1*a* of a device substrate 1 while they are arranged in an array in parallel with the one end edge 1*a* of the device substrate 1 with a predetermined distance held between adjacent heaters 2. Each heater 2 is composed of heaters 2*a* and 2*b* in the form of a pair. A common wiring portion 3 made of a metallic material such as aluminum or the like is formed between a pair of heaters 2, and it is electrically connected to electrodes of the heaters 2 on one side of the latter on the common basis. In addition, separated wiring portions 4 each made of a metallic material such as aluminum or a similar material are formed on electrodes of the heaters 2 on the opposite side to the foregoing one.

13 Claims, 7 Drawing Sheets

INK JET RECORDING HEAD HAVING A COMMON WIRING STRUCTURE AND INK JET RECORDING APPARATUS

This application is a continuation, of application Ser. No. 08/361,238 filed Dec. 21, 1994, now abandoned.

BACKGROUND OF THE INVENTION

1. Field of the Invention

The present invention relates to an ink jet recording apparatus and an ink jet recording head which is applicable to the apparatus, and more particularly to a thermal energy generating element in the recording head and a wiring structure of the head.

Here, it should be construed that a word "recording" means a technical concept of applying ink to all kinds of recording mediums each adapted to receive ink from the ink jet recording head, e.g., cloth, thread, paper and various kind of sheet-shaped material, or of performing the ink application independently on meaning of an image to be recorded. Further, it should be construed that a word "recording apparatus" includes a technical concept defined by various kinds of information processing apparatuses and a printer serving as an outputting unit for the information processing apparatuses. The present invention can be applied to each of the above apparatuses tor practical use ot the latter.

2. Description of the Prior Art

A recording apparatus having a function of serving as a printer, a copying machine, a facsimile and so forth or a recording apparatus operable as an outputting unit for complex type electronic equipment and a work station such as a computer, a word. processor and so forth is constructed such that an image is recorded on a recording medium in conformity with image information. For example, an ink jet recording system has been hitherto known as one of recording systems usable for the apparatuses as mentioned above. The ink jet recording system makes it possible to record an image on a recording medium with more excellent fineness than any other type of recording system. For this reason, attention has been hitherto paid to the ink jet recording system in additional consideration of a possibility that each recording operation can be performed at a comparatively high speed while generating a low intensity of noisy sound.

As is heretofore known in the art, an ink jet recording head usable for practicing the ink jet recording system (hereinafter referred to simply as a recording head) is constructed such that a plurality of square or rectangular heaters (each serving as a thermal energy generating element) are arranged on a substrate (device substrate) made of silicon, wiring is electrically connected to each heater, and moreover, an ink flow path is formed for each of the heaters on the base plate. In this case, the recording head may be constructed such that a plurality of heaters are arranged in the vicinity of one end edge of the base plate and the foregoing one end edge of the base plate constitutes a part of a face of the discharging portion. Each wiring is electrically connected to the individual heater. The heater is driven by supplying a driving signal through the wiring thereto.

With such construction, however, as the number of heaters is increased, the number of the wirings is also increased by two times as that of the heaters. Therefore, a width of each wiring must be unavoidably reduced as the number of heater is increased. There is fear that this leads to inconveniences that a value of resistance in the wiring range is increased, resulting in a quantity of electricity loss being correspondingly increased, and moreover, the temperature of the recording head is undesirably elevated, causing properties of the recording head to change disadvantageously.

In order to solve such problems, a method for reducing the number of the wiring to about a half is used, the method comprising a common wiring for connecting commonly the heaters to one another.

In the ink jet recording head, pulse-like electric current is applied to a plurality of heaters for a period of several $\mu$ seconds, causing ink to be discharged from the recording head by bubbles generated in ink by the heaters. Therefore, since an intensity of electric current, which flows instantaneously through the heater, is very high, there is fear that the intensity of driving electric current to be applied to each heater varies corresponding to image to be recorded due to resistance of wiring with the concentration of electric current when a common wiring is used for the heaters.

To cope with the foregoing inconveniences, Japanese Patent Application Laid-open No.208251/1985 (1985) discloses a method to be practiced such that a plurality of nozzles and ink flow paths are divided into a plurality of blocks, adjacent nozzles are assigned to different blocks, each block is driven at a different timing so as not to allow adjacent nozzles to be simultaneously driven, and common electrodes of two or three heaters are electrically connected to each other via a single wiring.

With the construction disclosed in the above publication, the number of the wirings can be reduced to three or four, and there is no fear to cause the problem described above regarding the concentration of the electric current because the number of the wiring is numerous.

However, with such construction, when a central axis of the heater substantially coincides with that of the nozzle like usual ink jet recording head, a pitch defined between one nozzle and another nozzle adjacent thereto is not equal. It causes the complex problem on the head structure that a plurality of nozzle arrays must be arranged in order to compensate the formation of a wide-pitch portion.

Furthermore, with the above arrangement of heaters, when only the nozzle pitch is equal, the coincidence between the central axis of the nozzle and that of the heater is largely off. There is fear that an excellent recording image cannot be obtained because the ink discharge in each nozzle is uneven.

On the other hand, in the conventional recording head, an intensity of kinetic energy owned by each ink droplet discharged from the recording head is held merely at a level of about 1/10000 of electric energy applied to each heater, resulting that an energy efficiency is not very high. This is attributable to the fact that a large amount of ink is caused to move in each nozzle without any contribution to ink discharge.

To improve a thermal energy converting efficiency, it is inevitably necessary that the nozzle structure is designed in an optimum manner. For example, in the case of a recording head of the type adapted to discharge ink in the direction substantially along a face of the device substrate on which the heater is arranged, it is possible to reduce an amount of ink which does not contribute to ink discharge, i.e., to reduce an amount of ink which is not practically discharged from the recording head on receipt of thermal energy by shortening the distance as measured from a heater to an ink discharge nozzle so as to allow an amount of ink filled in an ink flow path extending therebetween to be minimized. Also in this case, the recording head may be constructed such that gas bubbles generated in ink by the heaters are exhausted to the outside via the ink discharge nozzle.

However, when the distance between a heater and an ink discharging nozzle is intentionally shortened in that way, it becomes difficult from the viewpoint of a space to be occupied that a connection wiring portion for electrically connecting electrodes for a plurality of heaters to each other on the common basis is disposed between the heater and the ink discharge orifice. In this case, when a wiring between the heater and the discharge portion is reduced, a resistance in the wiring range is increased. When a high accuracy production apparatus such as a mask-aligner or a similar apparatus is employed because of the necessity for forming a fine wiring structure, there appears a drawback that the recording head is produced at an increased cost. The conventional wiring structure is preferably employable in the case that electric current is caused to flow in parallel with the direction of ink discharge, and is suitably employable in the case that heaters each having a long contour as seen in the direction of ink discharge are driven for the recording head. However, the conventional one is unsuitable in the case that heaters each having a long contour in the direction rectangular to the direction of ink discharge are driven for the recording head.

In the latter, when electric current is caused to flow in parallel with the direction of ink discharge, resistance of each heater is reduced compared with the former. Thus, there arises a necessity for allowing a high intensity of electric current to flow in order to drive the recording head at the same electric power as the conventional one. However, this leads to the result that the electric power loss induced by wiring resistance is undesirably increased.

SUMMARY OF THE INVENTION

The present invention has been made in consideration of the aforementioned background.

A primary object of the present invention is to provide an ink jet recording head having an improved wiring structure which assures that a small amount of electricity loss is induced by wiring resistance.

A secondary object of the present invention is to provide an ink jet recording head having a wiring structure in which a nozzle pitch is substantially constant.

A third object of the present invention is to provide an ink jet recording head in which an energy efficiency for ink discharge is high.

A fourth object of the present invention is to provide an ink cartridge including an ink jet recording head of the foregoing type.

A fifth object of the present invention is to provide an ink jet recording apparatus including an ink cartridge of the foregoing type.

According to a first aspect of the present invention, there is provided an ink jet recording head comprising a device substrate; and a plurality of thermal energy generating elements arranged in an array on the device substrate, the elements for changing the state of ink to thereby generate thermal energy sufficient to discharge the ink; wherein the elements are arranged at a substantive equal interval, and each of the elements includes a common wiring portion which belongs to one of two elements adjacent to the element, and an individual wiring portion opposing to the common wiring portion.

The two elements belonging to the same common wiring portion may be paired.

According to the first aspect of the present invention, since the number of wiring lines can be reduced owing to the provision of a plurality of common wiring portions, it is possible to reduce electric power loss induced by wiring resistance.

One end edge of the device substrate may constitute a part of a face of a discharging portion, and the plurality of thermal energy generating elements may be arranged in the vicinity of one end edge of the device substrate. With such construction, since a ratio of an amount of practically discharged ink to a total amount of ink having thermal energy received thereby can be increased, it is possible to substantially improve a thermal energy converting efficiency.

Additionally, according to the first aspect of the present invention, a plurality of thermal energy generating elements are arranged in substantive parallel with one end edge of the device substrate.

It further may comprise a connection wiring portion for electrically connecting the common wiring portions, the connection wiring portion being arranged on a portion of the device substrate between a row of the elements and the end edge of the device substrate. With such construction, since electric current is caused to flow also through the connection wiring portion in addition to the common wiring portion and the separated wiring portions, a value of electrical resistance of all the wiring portions can be reduced.

The connection wiring portion may be disposed on portion of the device substrate which is adjacent to the row of the elements. With such construction, the connection wiring portion is slightly parted away from one end edge of the device substrate. Thus, there does not arise a malfunction that the device substrate cracks during a cutting operation to be performed along one end edge of the device substrate when the ink jet recording head is actually incorporated in an ink jet recording apparatus.

The direction of discharging ink may be rectangular to an upper surface of the device substrate. With such construction, since the number of wiring lines can be reduced owing to the provision of a plurality of common wiring portions, it is possible to reduce a quantity of electricity loss induced by wiring resistance.

The element may be an electro-thermal converting element generating thermal energy sufficient to cause film boiling to ink. With such construction, each ink discharge can be achieved with excellent responsiveness.

According to a second aspect of the present invention, there is provided an ink cartridge, comprising: an ink jet recording head including; a device substrate having an end edge which constitutes a part of a face of discharging portion; and a plurality of thermal energy generating elements arranged in an array on the device substrate, the elements for changing the state of ink to thereby generate thermal energy sufficient to discharge the ink; wherein the elements are arranged at a substantive equal interval, and each of the elements includes a common wiring portion which belongs to one of two elements adjacent to the element, and an individual wiring portion opposing to the common wiring portion, and an ink container for storably receiving ink Lo be supplied to the ink jet recording head, the ink container being detachably fitted to the ink jet recording head.

In addition, according to a third aspect of the present invention, there is provided an ink cartridge, comprising: an ink jet recording head including; a device substrate; and a plurality of thermal energy generating elements arranged in an array on the device substrate, the elements for changing the state of ink to thereby generate thermal energy sufficient to discharge the ink in the direction rectangular to the an upper surface of the device substrate; wherein the elements are arranged at a substantive equal interval, and each of the elements includes a common wiring portion which belongs to one of two elements adjacent to the element, and an individual wiring portion opposing to the common wiring portion, and an ink container for storably receiving ink to be supplied to the ink jet recording head, the ink container being detachably fitted to the ink jet recording head.

With the ink cartridge constructed according to each of the second and third aspects of the present invention, supplementing of ink to be supplied to the ink jet recording head can simply be achieved merely by replacing the ink cartridge with a new one.

According to a fourth aspect of the present invention, there is provided an ink jet recording apparatus, comprising: an ink cartridge including; an ink jet recording head including; a device substrate having an end edge which constitutes a part of a face of discharging portion; and a plurality of thermal energy generating elements arranged in an array on the device substrate, the elements for changing the state of ink to thereby generate thermal energy sufficient to discharge the ink; wherein the elements are arranged at a substantive equal interval, and each of the elements includes a common wiring portion which belongs to one of two elements adjacent to the element, and an individual wiring portion opposing to the common wiring portion, and an ink container for storably receiving ink to be supplied to the ink jet recording head, the ink container being detachably fitted to the ink jet recording head; a carriage having the ink cartridge detachably mounted thereon; and driving means for reciprocably driving the carriage in the main scanning direction rectangular to the direction of conveying a recording medium.

Additionally, according to a fifth aspect of the present invention, there is provided an ink jet recording apparatus, comprising: an ink cartridge including; an ink jet recording head including; a device substrate; and a plurality of thermal energy generating elements arranged in an array on the device substrate, the elements for changing the state of ink to thereby generate thermal energy sufficient to discharge the ink in the direction rectangular to the an upper surface of the device substrate; wherein the elements are arranged at a substantive equal interval, and each of the elements includes a common wiring portion which belongs to one of two elements adjacent to the element, and an individual wiring portion opposing to the common wiring portion, and an ink container for storably receiving ink to be supplied to the ink jet recording head, the ink container being detachably fitted to the ink jet recording head, a carriage having the ink cartridge detachably mounted thereon, and driving means for reciprocably driving the carriage in the main scanning direction rectangular to the direction of conveying a recording medium.

With the ink jet recording apparatus constructed according to each of the fourth and fifth aspects of the present invention, since the ink cartridge is detachably mounted on the carriage adapted to be reciprocably displaced in the main scanning direction, the ink cartridge and the ink jet recording head can easily be replaced with new ones. Further, since the reduced number of wiring lines are formed on the device substrate for the ink jet recording head, it is possible to suppressively reduce a quantity of consumption of electricity required for discharging ink from the ink jet recording head.

The above and other objects, effects, features and advantages of the present invention will become more apparent from reading of the following description on preferred embodiments thereof which has been made in conjunction with the accompanying drawings.

BRIEF DESCRIPTION OF THE DRAWINGS

FIG. 2 is a plan view of the device substrate shown in. FIG. 1, showing the whole wiring structure of the device substrate;

DESCRIPTION OF THE PREFERRED EMBODIMENTS

The present invention will now be described in detail hereinafter with reference to the accompanying drawings which illustrate preferred embodiments thereof.

(Embodiment 1)

Figure 1:
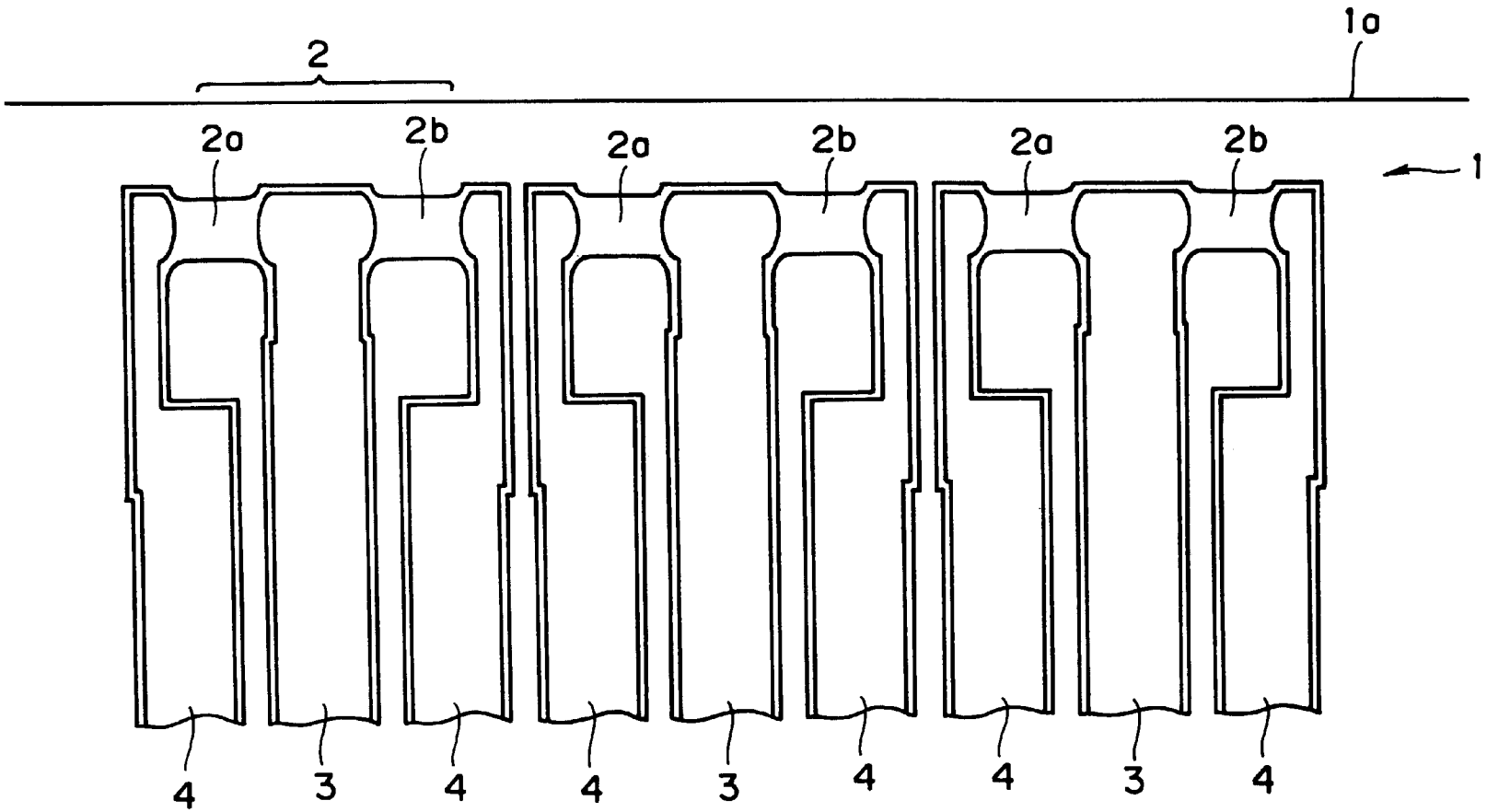
FIG. 1 is a fragmentary enlarged plan view of a device substrate for an ink jet recording head constructed in accordance with an embodiment of the present invention, showing a wiring structure of the device substrate.
Figure 2:
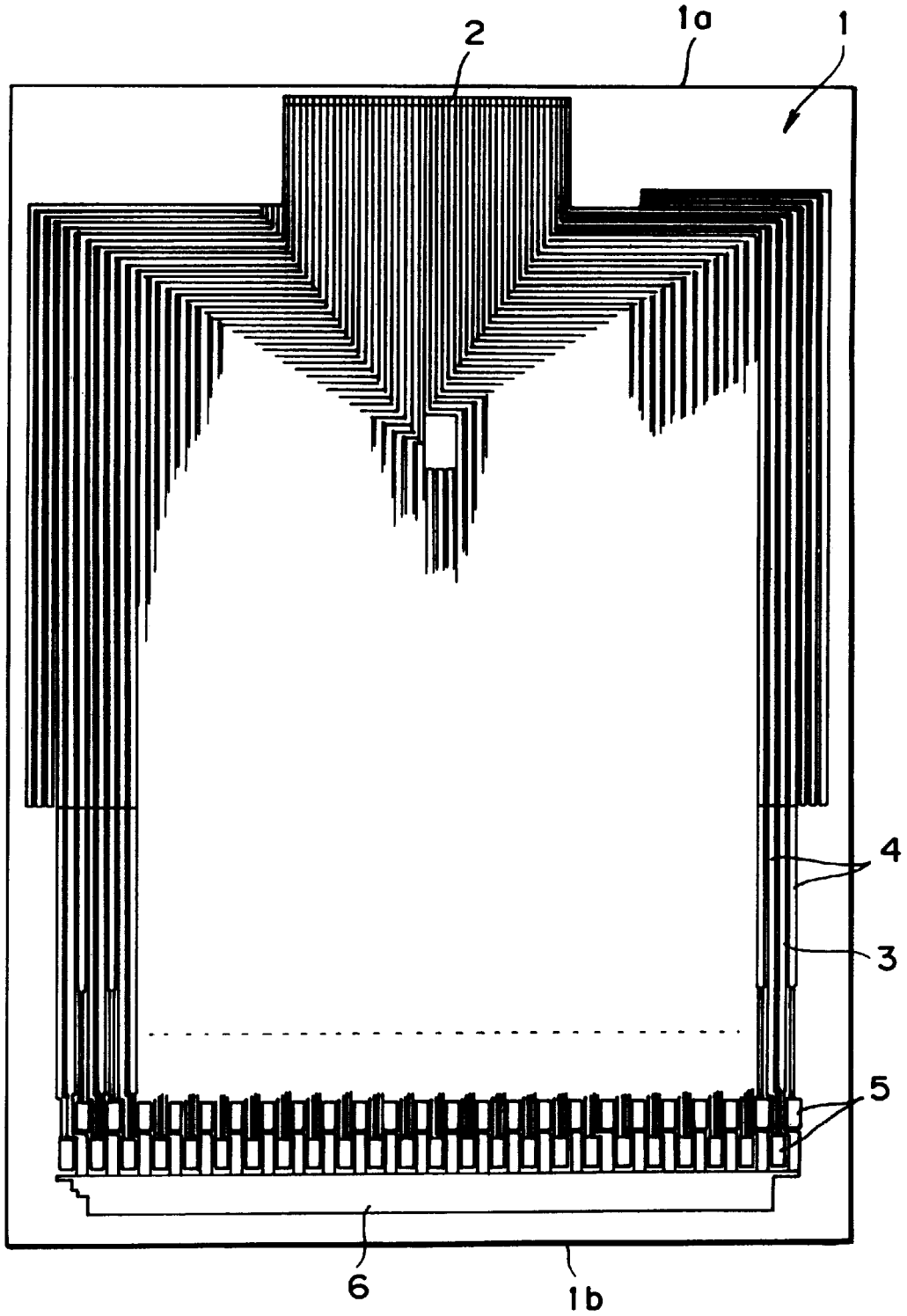

FIG. 1 is a fragmentary enlarged plan view of a device substrate for an ink jet recording head constructed in accordance with a first embodiment of the present invention, showing an essential part of the wiring structure of the device substrate located in the vicinity of an ink discharging plane, and FIG. 2 is a plan view of the device substrate shown in FIG. 1, showing the whole wiring structure of the device substrate.

In FIG. 1, reference numeral 1 designates a device substrate made of semiconductor such as silicon, and reference numeral 2 designates a plurality of heaters each made of a material such as hafnium boride ($HfB_2$) to serve as a thermal energy generating element or an electro-thermal converting element. In this embodiment, a plurality of substantially rectangular heaters 2 are formed at a constant interval or an the device substrate 1 in such a manner that they are located in the vicinity of an edge 1*a* of the device substrate 1 while they are arranged in an array so as to have a liner-periphery in the direction parallel with one end edge 1*a* of the device substrate 1. As shown in FIG. 1, two heaters 2*a* and 2*b* are paired, and disposed at a turn portion of the wiring structure which is the closest to the edge 1*a* of the device substrate 1. A common wiring portion 3 made of a metallic material such as aluminum is formed between adjacent two heaters 2 while it is electrically connected to one electrode of the heaters 2 on the common basis. In addition, two separated wiring portions 4 each made of metallic material such as aluminum are formed on the opposite electrodes of both the heaters 2. As shown in FIG. 2, each separated wiring portion 4 extends to the position in the vicinity of other end edge 1*b* opposite to the one end edge 1*a* of the device substrate 1 while stepwise reducing a width thereof, and it is connected to the corresponding bonding pad 5.

Each pair of heaters are electrically separated from other pair of heaters, and a distance between adjacent two heaters on the upper edge 1*a* side is different from that between a pair of heaters on the one end edge 1*b* side.

As shown in FIG. 2, all the common wiring portions 3 are connected to a common connecting portion 6 of the device substrate 1 located behind the bonding pads 5. Since it is possible to sufficiently reduce a. magnitude of resistance of each wiring portion located outside of the device substrate 1, it is acceptable that each wiring portion is formed on the common basis.

Here, one example of a method of forming the respective heaters and wiring portions on the base plate will be described below.

First, a resistive metallic film of $HfB_2$ having a thickness of about 0.1 $\mu$m is deposited on a silicon wafer including a surface oxide layer of $SiO_2$ having a thickness of about 2 $\mu$m by employing a spattering process. Subsequently, a wiring metallic film of aluminum having a thickness of about 0.5 $\mu$m is deposited on the resistive metallic film constituting each heater by employing a spattering process. Subsequently, each of the resistive metallic film and the wiring metallic film is subjected to patterning by employing a photolithographying process to exhibit a predetermined contour, whereby a wiring structure as shown in FIG. 1 can be obtained. To protect the respective metallic films, a protective film of $SiO_2$ (not shown) having a thickness of about 1 $\mu$m and a protective film of Ta (not shown) having a thickness of about 0.5 $\mu$m are successively deposited on the common wiring portions 3 and the separated wiring portions 4 each of which has been subjected to patterning, by employing a spattering process. Thereafter, an unnecessary part of the protective film composed of two layers is removed from the heaters 2, the common wiring portions 3 and the separate wiring portion 4 by employing a photolithographying process.

The device substrate 1 including the heaters 2 and the wiring portions 3 and 4 in that way is obtainable by way of the aforementioned steps. As will be described later, it is possible to incorporate the thus obtained device substrate 1 in an ink jet recording as head shown in FIG. 4 and FIG. 5, and moreover, it is possible to incorporate this ink jet recording head in an ink jet recording apparatus as shown in FIG. 7. It should be noted that the device substrate 1 is substantially identical to each of a heater board 100 and a device substrate 200 as shown in FIG. 6.

Referring to FIG. 1 again, a distance between the on end edge 1*a* of the device substrate 1 and a row of heaters 2 arranged in the spaced relationship in that way can be set to a predetermined size by cutting a part of the device substrate 1 on the one end edge 1*a* side during a cutting operation to be performed before the device substrate 1 is incorporated in the ink jet recording head.

The shown embodiment has been described above with respect to the case that the number of wiring portions with respect to each pair of heaters 2 is set to three represented by one common wiring portion 3 and two separate wiring portions 4 in contrast with the conventional base plate including four wiring portions. This means that the device substrate 1 according to the present embodiment is superior to the conventional one because a value of electric resistance of the wiring portions can remarkably be reduced, resulting in electric power loss caused due to the presence of wiring resistance being reduced compared with the conventional one. For example, when a value of wiring resistance of the device substrate 1 constructed in accordance with this embodiment is set to about 25 Ω, a value of wiring resistance of the conventional base plate corresponding the device substrate 1 of the present invention is about 40 Ω.

In this embodiment, the number of the wirings can be reduced without the concentration of current. The device substrate can be miniaturized even if a plurality of heaters are arranged thereon.

In this embodiment, the heaters are disposed at a periphery of the device substrate while reducing the number of the wirings by the arrangement of the heaters as described above, the heater having a rectangular shape with a long periphery in the direction along the edge of the device substrate.

Moreover, the nozzle pitch can be constantly controlled while the center of the nozzle substantially concides with that or the heater by means of the arrangement of the heaters as described above.

In this embodiment, in the case that a number of wiring lines are arranged in the equally spaced relationship with a very small pitch as shown in FIG. 1, to prevent a malfunction of short-circuit from occurring between adjacent two wiring lines, it is necessary that a predetermined gap is kept between adjacent two wiring lines. For this reason, the resistance value of each wiring portion largely varies much more than a ratio among the numbers of wiring lines. As is apparent from FIG. 2, since the size of each heater 2 is very small compared with the size of each of the bonding pad 5 and other associated components to be actually incorporated in the ink jet recording head, the size of each wiring portion required for electrically connecting the heater 2 and the bonding pad 5 to each other should gradually be reduced, e.g., from the bonding pad 5 side to the heater 2 side, resulting in the length of each wiring portion being proportionally elongated. This leads to the result that the resistance value of each wiring portion is unavoidably increased. In view of this fact, it is important that the number of wiring portions is reduced to keep the resistance value low. To this end, it is advantageously effective that the gap between adjacent wiring lines is reduced and the width of each wiring line is correspondingly widened. However, when the gap between adjacent wiring lines is intentionally reduced with respect to the whole wiring lines on the device substrate 1, a malfunction of rejection is liable of occurring from the viewpoint of production. In the circumstance as mentioned above, in this embodiment, the gap between adjacent wiring lines is set to a small value only at the limited position where it is difficult to widen the gap between adjacent wiring lines, and the gap between adjacent wiring lines at the position other than the foregoing one is set to a large value. It is apparent from FIG. 2 that the gap between adjacent wiring lines is reduced toward the heater 2. Provided that the gap between adjacent wiring lines is reduced only within the limited range as mentioned above, it is possible that a rate of occurrence of rejection can be kept low even when a mask-aligner having a comparatively low accuracy is employed for producing an ink jet recording head, whereby the ink jet recording head can be produced at a high yielding rate.

Since the ink jet recording head having the device substrate 1 incorporated therein in the above-described manner has a common wiring portion 3 which is common to the heaters 2*a* and 2*b* adjacent to each other paired when driving, a pair of the heaters 2*a* and 2*b* may be driven with different timing in order to prevent them from the concentration of current onto the common wiring portion. Therefore, all the heaters should be divided into two or more blocks, and driven at every block. In practice, it is preferable that in order to assure that a maximum intensity of electric current to flow through the whole ink jet recording head is kept low, the heaters are divisionally arranged in an increased number of blocks so as to allow them to be driven in the different timing relationship.

(Embodiment 2)

Figure 3:
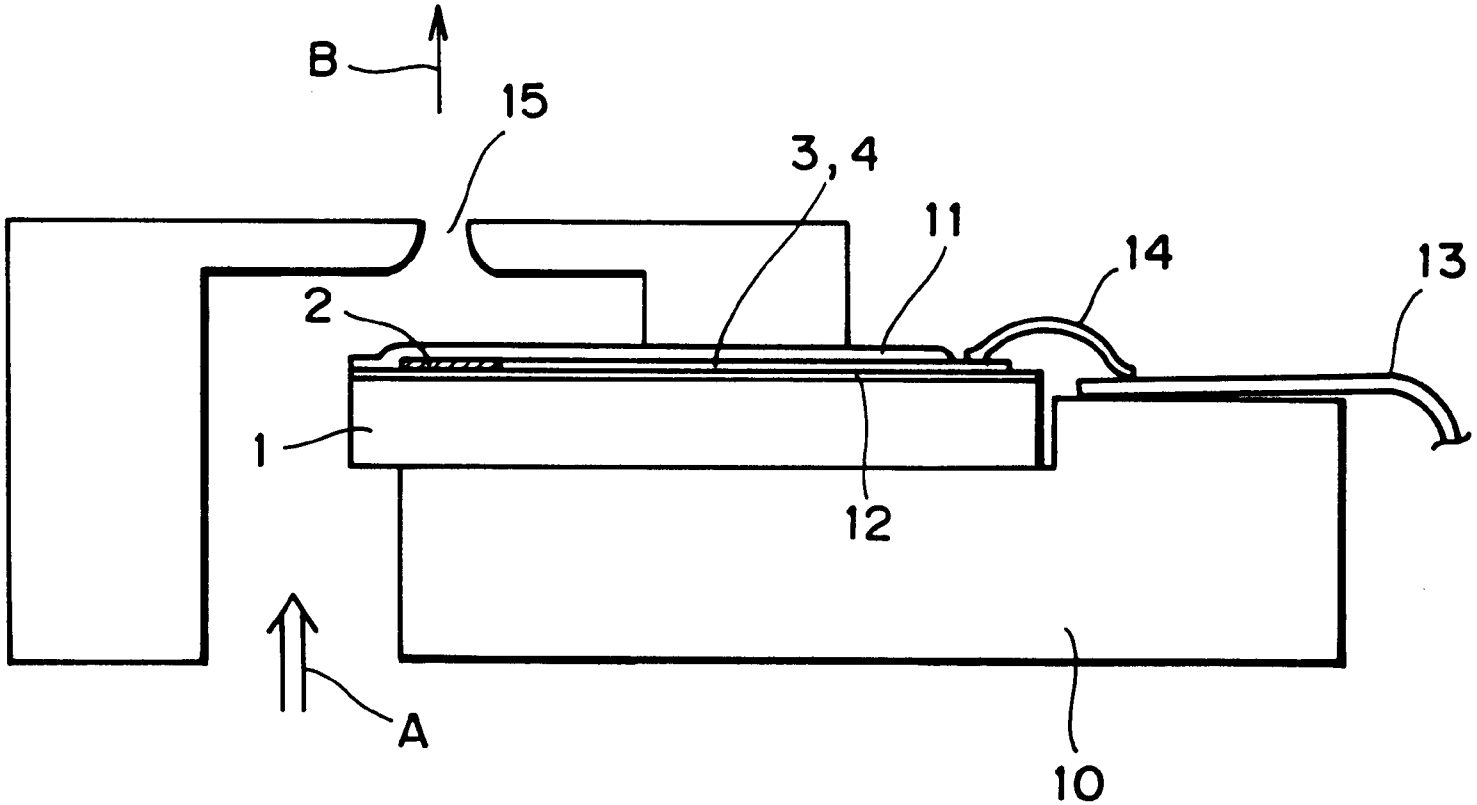
FIG. 3 is a sectional side view of an ink jet recording head constructed in accordance with other embodiment of the present invention, showing a laminated structure on a device substrate for the ink jet recording head.

FIG. 3 is a sectional side view of an ink jet recording head constructed in accordance with a second embodiment of the present invention, showing a laminated structure on a device substrate for the ink jet recording head.

In FIG. 3, reference numeral 10 designates a supporting member made of a metallic material. A device substrate 1 formed in the same manner as the first embodiment of the present invention is placed on the supporting member 10. In this embodiment, a protective film 11 of $SiO_2$ and Ta formed on a heater 2 and wiring lines 3 and 4 is shown in the drawing, and moreover, a film 12 of $SiO_2$ formed on the device substrate 1 is also shown in the drawing.

A flexible printed circuit board 13 is disposed on the supporting member 10, and terminals on the flexible printed wiring board 13 are electrically connected to terminals of the wiring portions 3 and 4 on the device substrate 1 via a plurality of bonding wirings 14.

An ink discharging orifice 15 is disposed directly above each heater 2 so that ink is discharged through the ink discharging orifice 15. As shown in FIG. 3, ink is supplied into the space located directly above the heaters 2 in the A arrow-marked direction, and subsequently, as diving electric current is applied to the device substrate 10, the ink is discharged through the ink discharging orifice 15 in the B arrow-marked direction.

In this embodiment, the distance as measured from the heater 2 to the ink discharging orifice 15 is not restrictively determined by wiring lines and associated components. However, it is necessary that the time which elapses after completion of the ink discharge from the ink discharging orifice 15 till the space extending from the heater 2 and the ink discharge orifice 15 is filled with ink is shortened as far as possible. Also in this embodiment, it is advantageously effective that the distance as measured from the heater 2 to one end edge 1*a* of the device substrate 1 is shortened.

(Embodiment 3)

Figure 4:
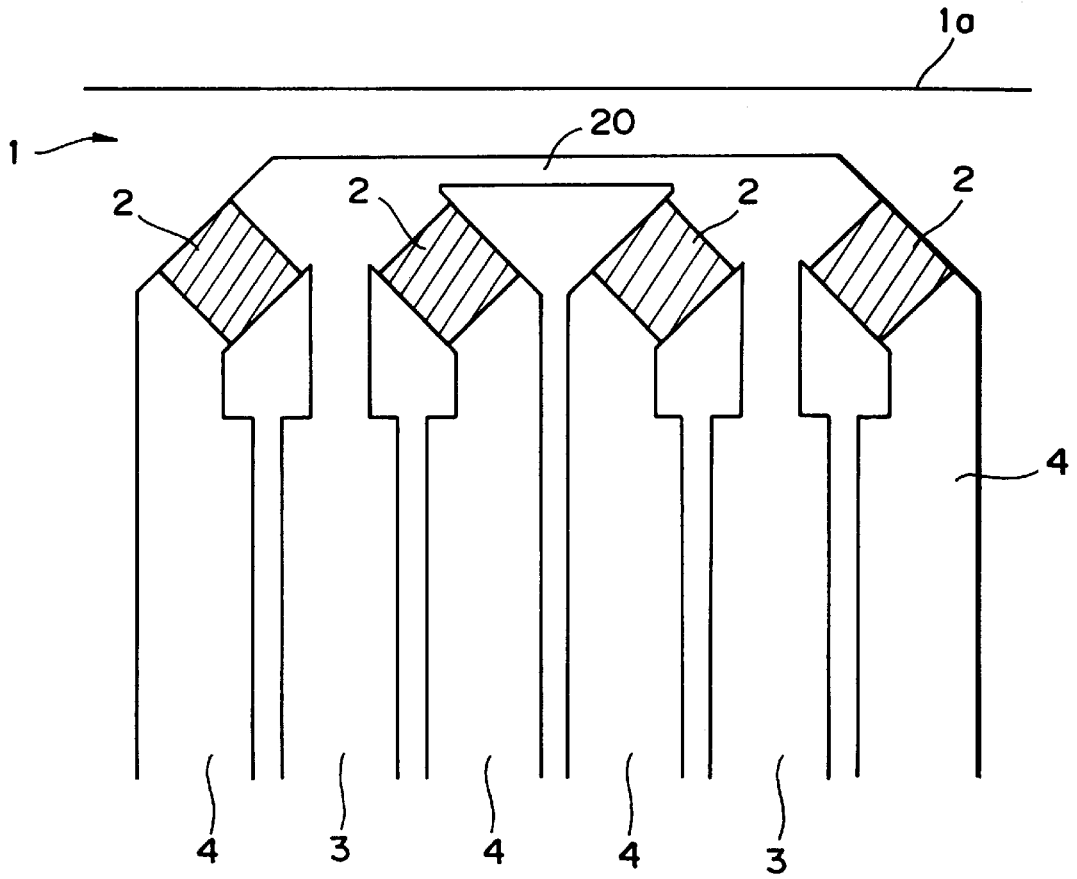
FIG. 4 is a fragmentary enlarged plan view of an ink jet head constructed in accordance with another embodiment of the present invention, showing an essential part of the wiring structure on a device substrate.

FIG. 4 is a fragmentary enlarged plan view of an ink jet recording head constructed in accordance with a third embodiment of the present invention, showing an essential part of the wiring structure of a base plate.

In this embodiment, a heater 2 is designed in the form of a square contour which is inclined by an angle of 45 degrees relative to one end edge 1*a* of a device substrate 1. In addition, a connection wiring portion 20 located in the vicinity of a group of heaters 2 for connecting a pair of common wiring portions 3 to each other is disposed between the group of heaters 2 and the device substrate 1. Since the group of heaters 2 and the connection wiring portion 20 are formed in the narrow space, it is unavoidable that the connection wiring portion 10 has a very small width.

Incidentally, the reason why the connection wiring portion 20 is located near to the group of heaters 2 consists in that there arises a necessity for parting the connection wiring portion 20 away from the one end edge 1*a* of the device substrate 1 because of a possibility that the device substrate 1 cracks during a cutting step to be practiced for cutting one end of the device substrate 1 when the device substrate 1 is actually incorporated in the ink jet recording head.

In this embodiment, since the heaters 2 are disposed at a constant interval, the nozzle pitch can be constant. Moreover, since a pair of common wiring portions 3 located adjacent to each other are electrically connected to each other via the connection wiring portion 20, it is necessary that each of four heaters 2 involved in the group of common wiring portions 3 is driven in the different timing relationship. In the case that the heaters 2 are driven in that way, when electric current is fed to a single heater 2, a large part of electric current flows through common wiring portions 3 and separated wiring portions 4 which are electrically connected to the heaters 2. In this case, since electric current flows through the connection wiring portion 20, an advantage is that a resistance value of each common wiring portion 3 is reduced to some extent. In the case that a high intensity of electric current is caused to flow through a fine wiring line made of a metallic material such as aluminum or a similar material there usually arises a problem that each wiring line is damaged or broken due to a phenomenon of migration. In this embodiment, since an intensity of electric current flowing through the connection wiring portion 20 is set to a half or less of that of electric current flowing through each heater 2 and associated components, the foregoing problem does not appear.

In contrast with the first embodiment of the present invention shown in FIG. 1, in this embodiment, each heater is not exposed to the edges of each common wiring portion 3 and each separated wiring portion 4. This is attributable to the fact that each heater 2, each common wiring portion 3 and each separated wiring portion 4 are simultaneously subjected to patterning by employing a photolithographying process in order to prevent each heater 2 from be exposed to the edges of each common wiring portion 3 and each separated wiring portion 4. In this embodiment, however, part of each heater 2 may be exposed to the edges of each common wiring portion 3 and each separated wiring portion 4.

In each of the aforementioned embodiments, each wiring portion is caused to extend outside of the base plate via a bonding wiring. However, the present invention should not be limited only to this. Alternatively, a driving circuit is preliminarily formed in a base plate made of silicon by employing, e.g., a hitherto known method of producing integral circuits in such a manner as to allow each wiring portion to be electrically connected to the driving circuit.

Figure 5:
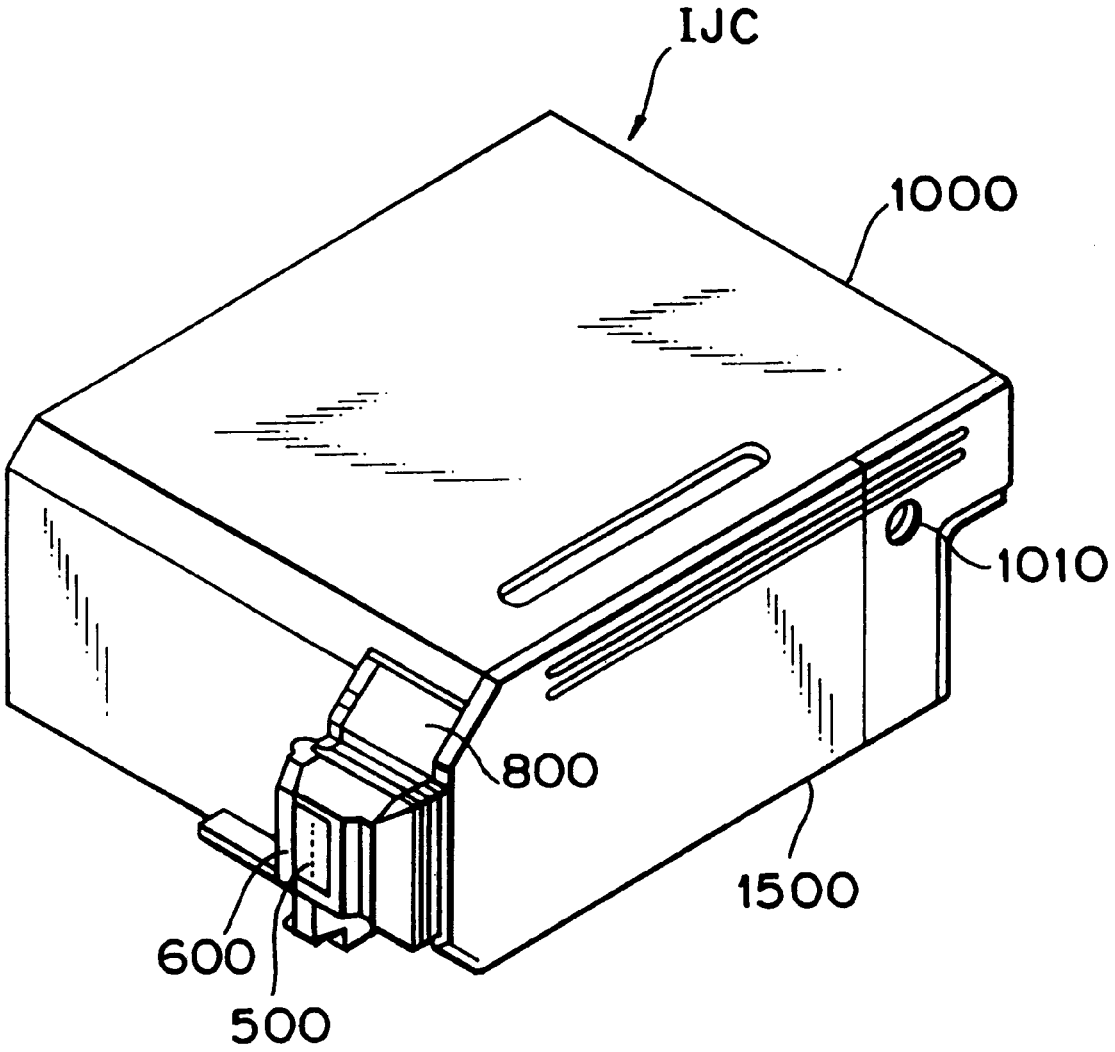
FIG. 5 is a perspective view of an ink jet cartridge to which the ink jet recording head constructed in accordance with each of the foregoing embodiments of the present invention is fitted.
Figure 6:
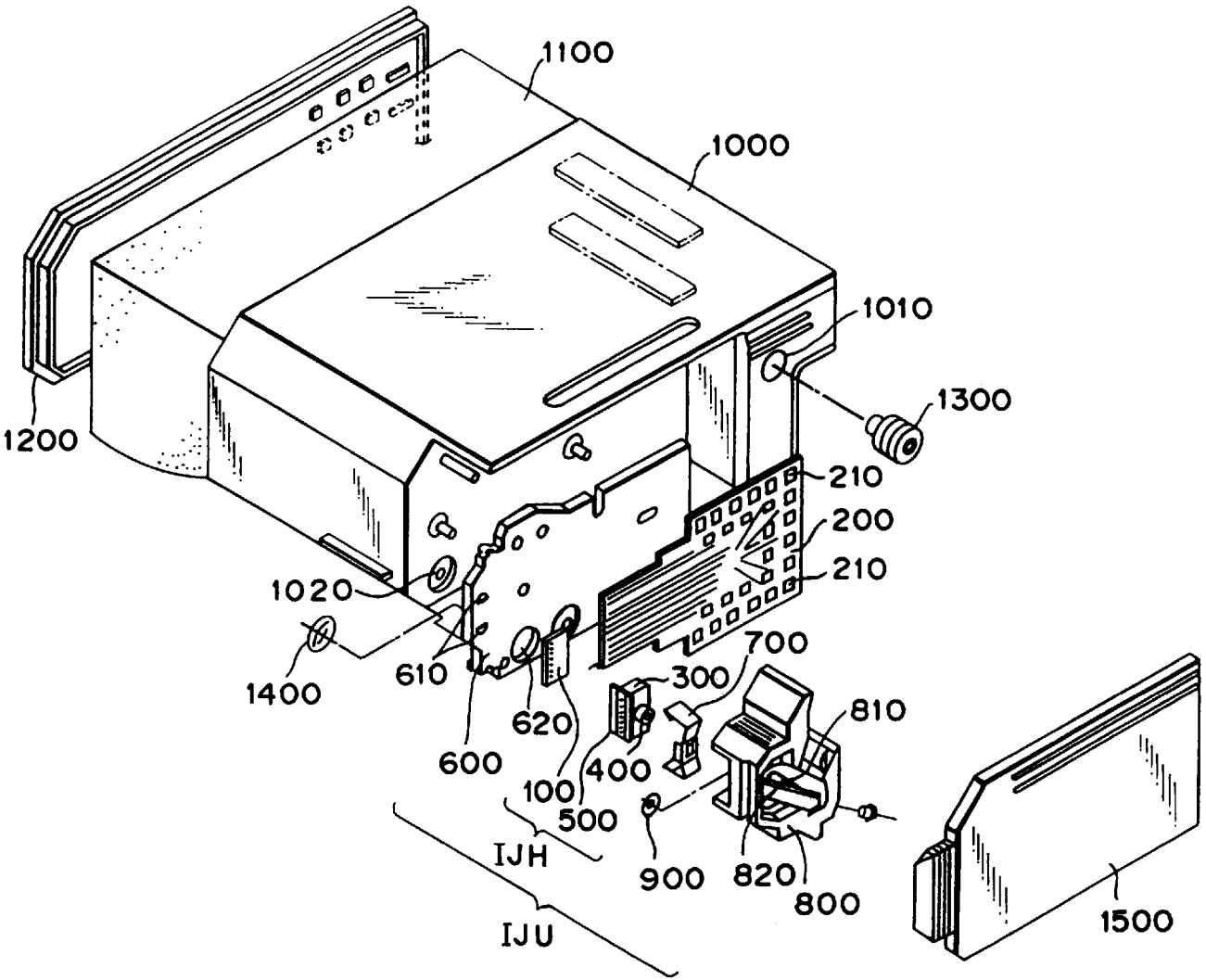
FIG. 6 is a perspective view of the ink jet cartridge shown in FIG. 5, showing the inner structure of the ink jet cartridge in the disassembled state.
Figure 7:
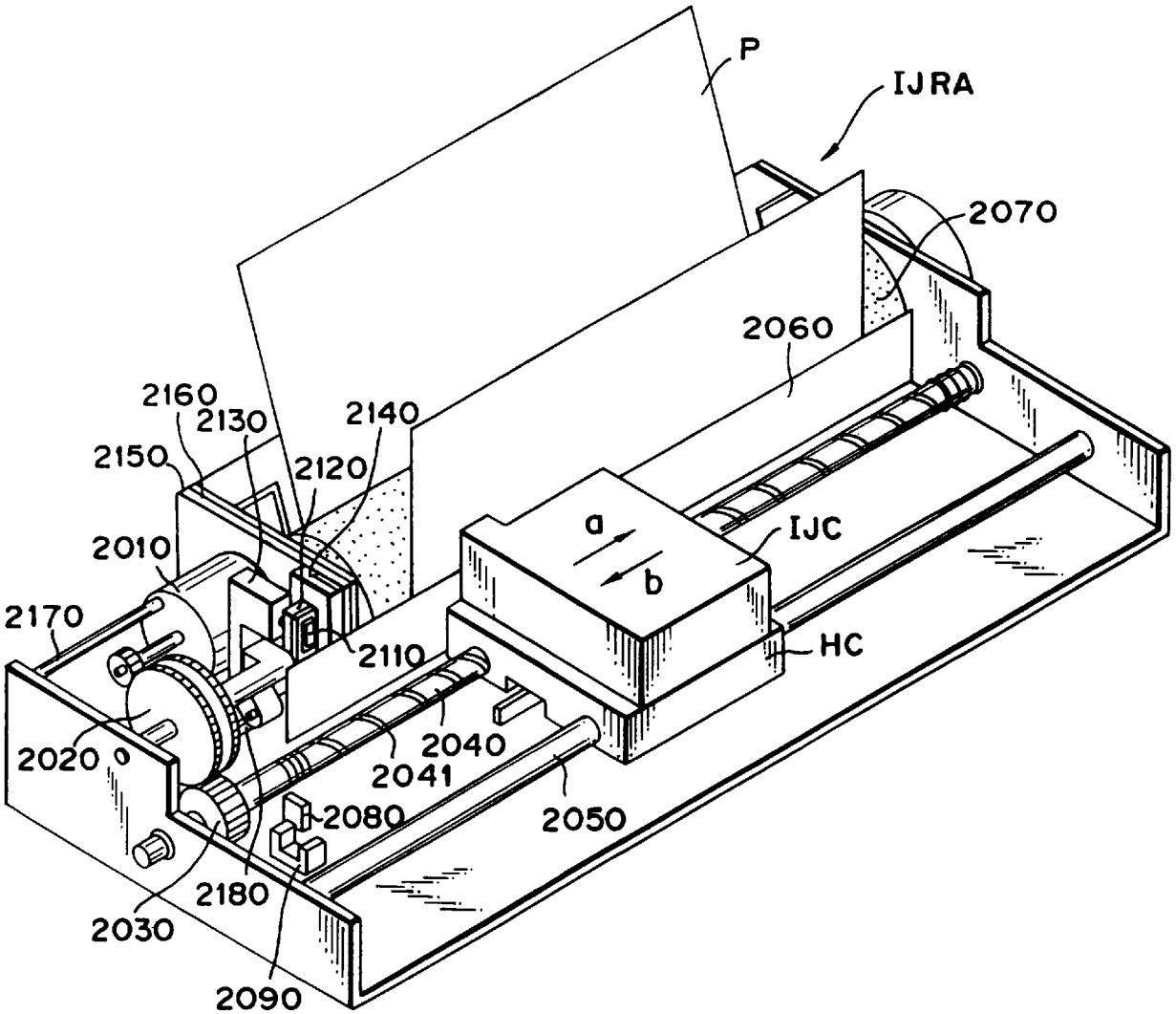
FIG. 7 is a perspective view of an ink jet recording apparatus constructed in accordance with a fourth embodiment of the present invention with the ink jet cartridge constructed in accordance with each of the foregoing embodiments mounted thereon, showing the outer structure of the ink jet recording apparatus.

FIG. 5 is a perspective view of an ink jet cartridge IJC to which the ink jet head constructed in the above-described manner is applied, and FIG. 6 is a perspective view of the ink jet cartridge IJK shown in FIG. 5, showing the inner structure of the ink jet cartridge in the disassembled state. In FIG. 6, reference numeral 100 designates a heater board which is formed on a base plate of silicon having a plurality of electrothermal transducers and a plurality of electric wiring lines each made of aluminum or a similar metallic material for feeding electricity to the electrothermal transducers arranged in the spaced relationship by employing a film forming technique, and reference numeral 200 designates a device substrate for the heater board 100. The device substrate 200 includes a plurality of wiring lines disposed corresponding to the wiring lines on the heater board 100 and a plurality of pads 210 located at one ends of the respective wiring lines to receive signals transmitted from a controller (not shown) of the ink jet cartridge IJC. Reference numeral 300 designates a ceiling plate which includes a plurality of ink flow paths, a common liquid chamber communicated with the ink flow paths, and a partition wall for separating the ink flow paths and the common liquid chamber from each other, reference numeral 400 designates an ink receiving port which is communicated with the common liquid chamber, and reference numeral 500 designates an orifice plate having a plurality of ink discharge orifices formed thereon. The orifice plate is integrally molded of a synthetic resin, e.g., polysulfon. Reference numeral 600 designates a supporting member which is made of, e.g., a metallic material to support the rear surface of the device substrate 200 with the opposing surface thereof. The supporting member 600 serves as a bottom plate for an ink jet unit IJU. Reference numeral 700 designates a retaining spring for firmly holding the ceiling plate 300 and the heater board 100 while bringing them in contact with the supporting member 600. Foot portions of the retaining spring 700 are brought in engagement with holes 610 formed through the supporting member 600. Reference numeral 800 designates an ink supplying member. The ink supplying member 800 includes an ink supplying pipe 810 of which one end is brought in pressure contact with an ink absorbing member 1100 via an ink supplying port 1020 of an ink container (tank) IT to be described later as well as an ink conducting pipe 820 of which one end integrally merges with the other end of the ink supplying pipe 810 and of which other end is brought in pressure contact with the ink receiving port 400. Reference numeral 900 designates a filter which is disposed at the one end of the ink supplying pipe 810 on the ink container IT side. A hole 620 is formed through the supporting member 600 so as to allow the ink supplying pipe 810 to extend therethrough.

To supply ink to the ink jet unit IJU constructed in the above-described manner, the ink container IT is substantially composed of a casing 1000 of the ink jet cartridge IJC, an ink absorbing member 1100 for impregnating ink therein, and a cover member 1200 for sealably closing an opening portion of the cartridge casing 1000 therewith after the ink absorbing member 1100 is inserted into the cartridge casing 1000 from the opposite side to come in tight contact with the ink jet unit IJU fitting surface of the cartridge casing 1000 An atmosphere communicating port 1010 is formed through the cartridge casing 1000 so as to allow atmospheric air to be introduced into the ink container IT therethrough, and a liquid expelling member 1300 is inserted into the atmosphere communication port 1010 for the purpose of preventing ink from leaking to the outside through the atmosphere communicating port 1010. In addition, an ink supplying port 1020 is formed on the cartridge casing 1000, and a packing 1400 is received in the ink supplying port 1020. The ink jet unit IJU constructed in the above-described manner is secured to the cartridge casing 1000 by affixing a side surface supporting member 600 to the cartridge casing 1000 on the opposite side to the ink absorbing member 1100 inserting side, and the interior of the ink jet unit IJU is closed with a cover 1500.

FIG. 7 is a perspective view which shows by way of example the structure of an ink jet recording apparatus IJRA having an ink jet cartridge IJC constructed in that way mounted thereon. This ink jet recording apparatus IJRA includes a lead screw 2040 which is rotated by a driving motor 2010 via driving force transmitting gears 2020 and 2030 as the driving motor 2010 is rotated in the normal/reverse direction. A carriage HC having an ink cartridge IJC detachably mounted thereon is supported by a carriage shaft 2050 and the lead screw 2040 both of which extend in parallel with each other, and the carriage HC includes an engagement pin (not shown) adapted to be engaged with a spirally extending groove 2041 on the lead screw 2040. With this construction, as the lead screw 2040 is rotated in the normal/reverse direction, the carriage HC is reciprocably displaced in the a arrow-marked direction or in the b arrow-marked direction. Reference numeral 2060 designates a paper retaining plate which serves to thrust a paper P, i.e., a recording medium, against a platen 2070 along the width defined by the range where the carriage HC can reciprocably be displaced in the leftward/ rightward direction. Reference numerals 2080 and 2090 designate photocouplers, respectively. Each of the photocouplers 2080 and 2090 operates as home position detecting means for changing the direction of rotation of the driving motor 2010 to the opposite one by optically recognizing the presence of a lever 2100 projecting outside of the carriage HC, within the range defined by the photocouplers 2080 and 2090. Reference numeral 2110 designates a capping member for capping the front surface of an ink jet recording head therewith. The capping member 2110 is supported by a supporting member 2120. Reference numeral 2030 designates sucking means for evacuating the interior of a cap. The sucking means 2030 performs a recoverable sucking operation by sucking gas in the cap through a hole formed in the cap. A cleaning blade 2140 for cleaning the end surface of the cap by wiping the same therewith is disposed on a member 2150 in such a manner as to move in the forward/rearward direction. The cleaning blade 2140 is movably supported by a supporting plate 2160 on the casing side. However, the present invention should not be limited only to the structure shown in the drawing and described above. It of course is obvious that any other type of hitherto known cleaning blade may equally be employed for the ink jet recording apparatus IJRA. Reference numeral 2170 designates a lever for starting a recoverable sucking operation for the ink jet cartridge IJC. As a cam 2180 adapted to be. engaged with the carriage HC is rotated, the lever 2170 is displaced for the purpose of starting a recoverable sucking operation. With such construction, as the driving power generated by the driving motor 2010 is transmitted to the lead screw 2040 via hitherto known power transmitting means such as a clutch or a similar component, the carriage HC is controllably displaced in the a arrow-marked direction or in the b arrow-marked direction.

As described above, the ink jet recording apparatus IJRA is constructed such that a capping operation, a cleaning operation and a recoverable sucking operation are performed with the aid of the lead screw 2040 when the carriage HC reaches a predetermined location on the home position side. Alternatively, each of the aforementioned operations may be performed in accordance with any other type of hitherto known timing relationship. It should be noted that each of the aforementioned structures constitutes an excellent invention as evaluated not only from the viewpoint of a single structure but also from the viewpoint of complex structures and that each of these structures represents an example of structure preferably employable for carrying out the present invention.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifice of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary S heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy ot the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 712601/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As is apparent from the above description, according to the present invention, among a plurality of thermal energy generating elements, adjacent two thermal energy generating elements cooperate with each other in the form of a pair, a common wiring portion is disposed between both the thermal energy generating elements while the former is electrically connected to the latter, and separated wiring portions are electrically connected to the pair of thermal energy generating elements. Consequently, the present invention can provide an ink jet recording head and an ink jet recording apparatus including the foregoing type of ink jet recording head each of which assures that the number of wiring lines can be reduced, and moreover, a quantity of electricity loss caused by wiring resistance can be reduced.

In addition, according to the present invention, a plurality of thermal energy generating elements are arranged in the vicinity of one end edge of a device substrate constituting part of an ink discharging plane of the ink jet recording head. Consequently, the present invention can provide an ink jet recording head and an ink jet recording apparatus including the foregoing type of ink jet recording head each of which assures that a quantity of ink which can not practically be discharged from the ink jet recording head even though thermal energy is received from the thermal energy generating elements can be reduced as far as possible, and moreover, a thermal energy converting efficiency can substantially be improved.

While the present invention has been described above with respect to a few preferred embodiments thereof, it should of course be understood that the present invention should not be limited only to these embodiments but various change or modification may be made without any departure away from the scope of the present invention as defined by the appended claims.

What is claimed is:

1. An ink jet recording head, comprising:

a device substrate having an edge which constitutes a part of a face of a discharging portion; and a plurality of thermal energy generating elements arranged in an array on said device substrate and which change a state of an ink to thereby generate thermal energy sufficient to discharge the ink, wherein said elements are arranged at a substantially equal interval, and a first element of said plurality of elements is adjacent to a second element of said plurality of elements a first individual wiring portion for supplying a signal only to said first element is connected only to said first element and a second individual wiring portion for supplying a signal only to said second element is connected only to said second element, wherein the thermal energy generating elements include a plurality of pairs, each said pair having one said first element and one said second element in that order repeatedly are respectively arranged in an array at a substantially equal interval, and said first and said second elements are connected to a common wiring portion, said common wiring portion being arranged between said first and said second elements, wherein said first and said second elements are disposed at a turn portion of a wiring structure which is closest to the edge of the device substrate.

2. A head as claimed in claim 1, wherein said first and second elements connected to the common wiring portion are electrically paired.

3. A head as claimed in claim 2, wherein one end edge of said device substrate constitutes a part of a face of a discharging portion, and said plurality of thermal energy generating elements are arranged in a vicinity of the one end edge of the device substrate.

4. A head as claimed in claim 3, wherein said plurality of thermal energy generating elements are arranged substantially parallel to the one end edge of said device substrate.

5. A head as claimed in claim 4, further comprising a connection wiring portion for electrically connecting the common wiring portion, the connection wiring portion being arranged on a portion of said device substrate between a row of said elements and an end edge of said device substrate.

6. A head as claimed in claim 5, wherein the connection wiring portion is disposed on a portion of the device substrate which is adjacent to the row of the elements.

7. A head as claimed in claim 2, wherein a direction of discharging ink is perpendicular to an upper surface of the device substrate.

8. A head as claimed in claim 1, wherein the element is an electro-thermal converting element generating thermal energy sufficient to cause film boiling to ink.

9. An ink jet recording head as claimed in claim 1, wherein the common wiring portion is connected to said first and second elements without any junction.

10. An ink cartridge, comprising:

an ink jet recording head including:

a device substrate having an edge which constitutes a part of a face of a discharging portion; and a plurality of thermal energy generating elements arranged in an array on said device substrate and which change a state of an ink to thereby generate thermal energy sufficient to discharge the ink in a direction perpendicular to an upper surface of said device substrate, wherein the elements are arranged at a substantially equal interval, and a first element of said plurality of elements is adjacent to a second element of said plurality of elements a first individual wiring portion for supplying a signal only to said first element is connected only to said first element and a second individual wiring portion for supplying a signal only to said second element is connected only to said second element, wherein the thermal energy generating elements include a plurality of pairs, each said pair having one said first element and one said second element in that order repeatedly are respectively arranged in an array at a substantially equal interval, and said first and said second elements are connected to a common wiring portion, said common wiring portion being arranged between said first and said second elements, wherein said first and said second elements are disposed at a turn portion of a wiring structure which is closest to the edge of the device substrate; and an ink container for storably receiving ink to be supplied to said ink jet recording head, the ink container being detachably fitted to the ink jet recording head.

11. An ink jet recording apparatus, comprising:

an ink cartridge including:

an ink jet recording head including:

a device substrate having an edge which constitutes a part of a face of a discharging portion; and a plurality of thermal energy generating elements arranged in an array on the device substrate and which change a state of an ink to thereby generate thermal energy sufficient to discharge the ink, wherein said elements are arranged at a substantially equal interval, and a first element of said plurality of elements is adjacent to a second element of said plurality of elements a first individual wiring portion for supplying a signal only to said first element is connected only to said first element and a second individual wiring portion for supplying a signal only to said second element is connected only to said second element, wherein the thermal energy generating elements include plurality of pairs, each said pair having one said first element and one said second element in that order repeatedly are respectively arranged in an array at a substantially equal interval, and said first and said second elements are connected to a common wiring portion, said common wiring portion being arranged between said first and said second elements, wherein said first and said second elements are disposed at a turn portion of a wiring structure which is closest to the edge of the device substrate; and an ink container for storably receiving the ink to be supplied to said ink jet recording head, the ink container being detachably fitted to said ink jet recording head;

a carriage having said ink cartridge detachably mounted thereon; and driving means for reciprocally driving said carriage in a main scanning direction perpendicular to a direction of conveying a recording medium.

12. An ink jet recording apparatus, comprising:

an ink cartridge including:

an ink jet recording head including:

a device substrate having an edge which constitutes a part of a face of a discharging portion; and a plurality of thermal energy generating elements arranged in an array on the device substrate and which change a state of an ink to thereby generate thermal energy sufficient to discharge the ink in a direction perpendicular to an upper surface of the device substrate, wherein said elements are arranged at a substantially equal interval, and a first element of said plurality of elements is adjacent to a second element of said plurality of elements a first individual wiring portion for supplying a signal only to said first element is connected only to said first element and a second individual wiring portion for supplying a signal only to said second element is connected only to said second element, wherein the thermal energy generating elements include a plurality of pairs, each said pair having one said first element and one said second element in that order repeatedly are respectively arranged in an array at a substantially equal interval, and said first and said second elements are connected to a common wiring portion, said common wiring portion being arranged between said first and said second elements, wherein said first and said second elements are disposed at a turn Portion of a wiring structure which is closest to the edge of the device substrate;

an ink container for storably receiving the ink to be supplied to said ink jet recording head, said ink container being detachably fitted to said ink jet recording head;

a carriage having said ink cartridge detachably mounted thereon; and driving means for reciprocally driving said carriage in a main scanning direction perpendicular to a direction of conveying a recording medium.

13. An ink cartridge, comprising:

an ink jet recording head including:

a device substrate having an edge which constitutes a part of a face of a discharging portion; and a plurality of thermal energy generating elements arranged in an array on said device substrate and which change a state of an ink to thereby generate thermal energy sufficient to discharge the ink, wherein said elements are arranged at a substantially equal interval, and a first element of said plurality of elements is adjacent to a second element of said plurality of elements a first individual wiring portion for supplying a signal only to said first element is connected only to said first element and a second individual wiring portion for supplying a signal only to said second element is connected only to said second element, wherein the thermal energy generating elements include a plurality of pairs, each said pair having one said first element and one said second element in that order repeatedly are respectively arranged in an array at a substantially equal interval, and said first and said second elements are connected to a common wiring portion, said common wiring portion being arranged between said first and said second elements, wherein said first and said second elements are disposed at a turn portion of a wiring structure which is closest to the edge of the device substrate; and an ink container for storably receiving the ink to be supplied to the ink jet recording head, the ink container being detachably fitted to said ink jet recording head.

* * * * *

UNITED STATES PATENT AND TRADEMARK OFFICE

CERTIFICATE OF CORRECTION

PATENT NO. : 6,183,066 B1
DATED : February 6, 2001
INVENTOR(S) : Yasuyuki Tamura et al.

It is certified that error appears in the above-identified patent and that said Letters Patent is hereby corrected as shown below:

Title page,
Item [56], References Cited, FOREIGN PATENT DOCUMENTS, "2150356" should read -- 2-150356 --.

Column 1,
Line 18, "kind" should read -- kinds --; and
Line 65, "heater" should read -- heaters --.

Column 2,
Line 34, "usual" should read -- a usual --.

Column 3,
Line 13, "The" should read -- ¶ The --;
Line 22, close up right margin;
Line 23, close up left margin; and
Line 58, "substantive" should read -- substantially --.

Column 4,
Line 15, "in substantive" should read -- substantially --;
Line 26, "on" should read -- on a --;
Line 47, "including;" should read -- including --;
Line 53, "substantive" should read -- substantially --;
Line 58, "Lo" should read -- to --; and
Line 64, "including;" should read -- including --.

Column 5,
Line 1, "the an" should read -- an --;
Line 3, "substantive" should read -- substantially --;
Line 16, "including;" should read -- including --;
Line 17, "ing;" should read -- ing: --;
Line 23, "substantive" should read -- substantially --;
Line 36, "including;" should read -- including --;
Line 37, "including;" should read -- including: --;
Line 41, "the an" should read -- an --;
Line 43, "substantive" should read -- substantially --; and
Line 63, "suppressively" should be deleted.

Column 7,
Line 32, "photolithographying" should read -- photolithographic --;
Line 44, "thographying" should read -- thographic --; and
Line 55, "on" should read -- one --.

UNITED STATES PATENT AND TRADEMARK OFFICE

CERTIFICATE OF CORRECTION

PATENT NO. : 6,183,066 B1
DATED : February 6, 2001
INVENTOR(S) : Yasuyuki Tamura et al.

It is certified that error appears in the above-identified patent and that said Letters Patent is hereby corrected as shown below:

Column 8,
Line 22, “concides” should read -- coincides --; and
Line 50, “of occurring” should read -- to occur --.

Column 9,
Line 63, close up right margin.

Column 10,
Line 22, “material” should read -- material, --;
Line 35, “photolithographying” should read -- photolithographic --;
Line 36, “be” should read -- being --; and
Line 53, “IJK” should read -- IJC --.

Column 12,
Line 37, “be.” should read -- be --.

Column 13,
Line 45, “consists” should read -- consist --; and
Line 62, “S” should be deleted.

Column 15,
Line 21, “elements” should read -- elements, --.

Column 16,
Line 13, “elements” should read -- elements, --;
Line 46, “elements” should read -- elements, --; and
Line 53, “plurality” should read -- a plurality --.

UNITED STATES PATENT AND TRADEMARK OFFICE

CERTIFICATE OF CORRECTION

PATENT NO. : 6,183,066 B1
DATED : February 6, 2001
INVENTOR(S) : Yasuyuki Tamura et al.

It is certified that error appears in the above-identified patent and that said Letters Patent is hereby corrected as shown below:

Column 17,
Line 19, “elements” should read -- elements,--; and
Line 35, “Portion” should read -- portion --.

Column 18,
Line 18, “elements” should read -- elements, --.

Signed and Sealed this

Fourteenth Day of September, 2004

JON W. DUDAS
*Director of the United States Patent and Trademark Office*